US005334037A

United States Patent [19]

Gabrius, Algimantas J. et al.

[11] Patent Number: 5,334,037

[45] Date of Patent: Aug. 2, 1994

[54] ADAPTER BOX FOR LOW VOLTAGE FIXTURE

[75] Inventors: Gabrius, Algimantas J., Carol Stream; Thomas J. DeCicco, Arlington Heights, both of Ill.

[73] Assignee: Juno Lighting, Inc., Des Plaines, Ill.

[21] Appl. No.: 117,501

[22] Filed: Sep. 7, 1993

[51] Int. Cl.[5] ..... H01R 25/14

[52] U.S. Cl. ..... 439/118

[58] Field of Search ..... 439/118, 121, 117, 119, 439/122, 94, 116, 529-531, 542, 110-115, 533, 332-337

[56] References Cited

U.S. PATENT DOCUMENTS

| | | | |
|---|---|---|---|
| 4,092,507 | 5/1978 | Lawrence | 439/115 |
| 4,108,523 | 8/1978 | Bolis | 439/116 |
| 4,699,439 | 10/1987 | Cohen | 439/119 |
| 4,768,964 | 9/1988 | Zucchini | 439/121 |
| 4,776,809 | 10/1988 | Hall | 439/121 |
| 5,013,251 | 5/1991 | Stringer et al. | 439/118 |

*Primary Examiner*—Gary F. Paumen

*Attorney, Agent, or Firm*—Anthony S. Zummer

[57] ABSTRACT

An adapter box for attaching a low voltage lighting fixture to a low voltage track. The track has an insulator track body with a pair of parallel conductive wires mounted in the body. The body has a longitudinal web with a flange formed integral with each of opposed sides. A pair of opposed inwardly extending edges is formed integral with the flanges to provide an open space between the edges. The adapter box includes a pair of insulator housing halves secured to each other. Each housing half having a portion of each of a pair of mounting ears connectable to the track body at the opposed edges. The housing halves define a contact opening adjacent to the mounting ears. A pair of contacts is mounted in the housing halves for engaging in electrically conductive contact with the respective conductive wires in the body. A fixture wire is connected to each of the contacts. A contact separator is formed integral with one of said housing halves adjacent to the contact opening for holding the contacts apart. A wire guide assembly is mounted in the housing halves providing a conduit through assembled housing halves. A latch is mounted in one of the housing halves for selectively preventing the housing halves from rotating relative to the track body while the contacts are in electrically conductive contact with the respective parallel conductive wires.

15 Claims, 5 Drawing Sheets

ADAPTER BOX FOR LOW VOLTAGE FIXTURE

BACKGROUND OF THE INVENTION

An adapter box is used for attaching a low voltage track lighting fixture to a low voltage track. Customarily, track lighting operates on 120 volts. Each lighting fixture carries with it a step-down transformer to provide low voltage current to the lighting fixture. Typically, the low voltage lighting fixtures used in track lighting operate on 12 volts.

Whenever an adapter is used with a track lighting system, it is necessary to provide a firm electrical contact between the contacts of the adapter and the conductive wires or bus bars of the track. In the conventional construction of a track lighting system utilizing 120 volts, a small voltage drop at the contacts typically does not create any problems. However, when the voltage is only 12 volts even a small voltage drip at the contacts may create a noticeable effect on the operation of a lighting fixture which is intended to operate on 12 volts.

The problem encountered with an adapter for use on a low voltage track lighting system is that there must be a good electrical contact between the conductive wires or the bus bars in the track and the lighting fixture. In addition, the lighting fixture must be securely mechanically connected to the track so that the lighting fixture is securely held in place.

SUMMARY OF THE INVENTION

The subject matter of the present invention is an adapter box which connects a low voltage lighting fixture to a low voltage lighting fixture track in a manner such that there is a good electrical conduction between the track wires or track bus bars and the lighting fixture, as well as, a secure mechanical connection between the track and the adapter. A typical low voltage lighting fixture track includes an insulator track body and a pair of parallel conductive wires or bus bars mounted in the body. The body has an elongated web with a flange formed integral with each of opposed elongated sides of the web. A pair of opposed inwardly extended edges is formed integral with the flanges extending along the length of the body so that there is a space between the opposed edges of the body.

The adapter box includes a pair of insulator housing halves secured to each other. Each housing half has a portion of each of a pair of mounting ears connectable to the track body at the opposed edges. The housing halves define a contact opening adjacent to and between the mounting ears. A pair of contacts is mounted in the housing halves for electrically conductive contact with respective conductive wires in the track body. A fixture wire is connected to each of the contacts. A contact separator is formed integral with one of the housing halves adjacent to the contact opening holding the contacts apart. A wire guide assembly is mounted in the housing halves providing a conduit for the fixture wires through the assembled housing halves. A latch is mounted on one of the housing halves for engagement with the track body for selectively preventing the housing halves from rotating relative to the track body.

DETAILED DESCRIPTION OF THE INVENTION

Figure 1:
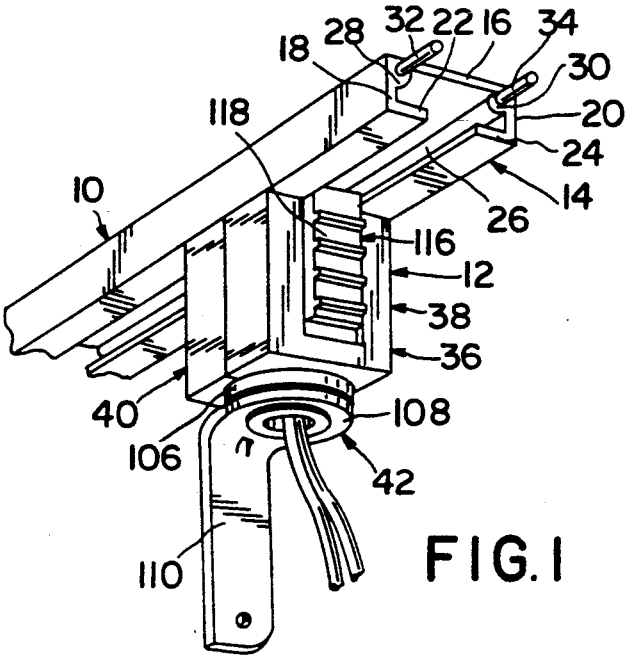
FIG. 1 is a perspective view of an adapter box embodying the herein disclosed invention mounted on a conventional low voltage fixture track.
Figure 2:
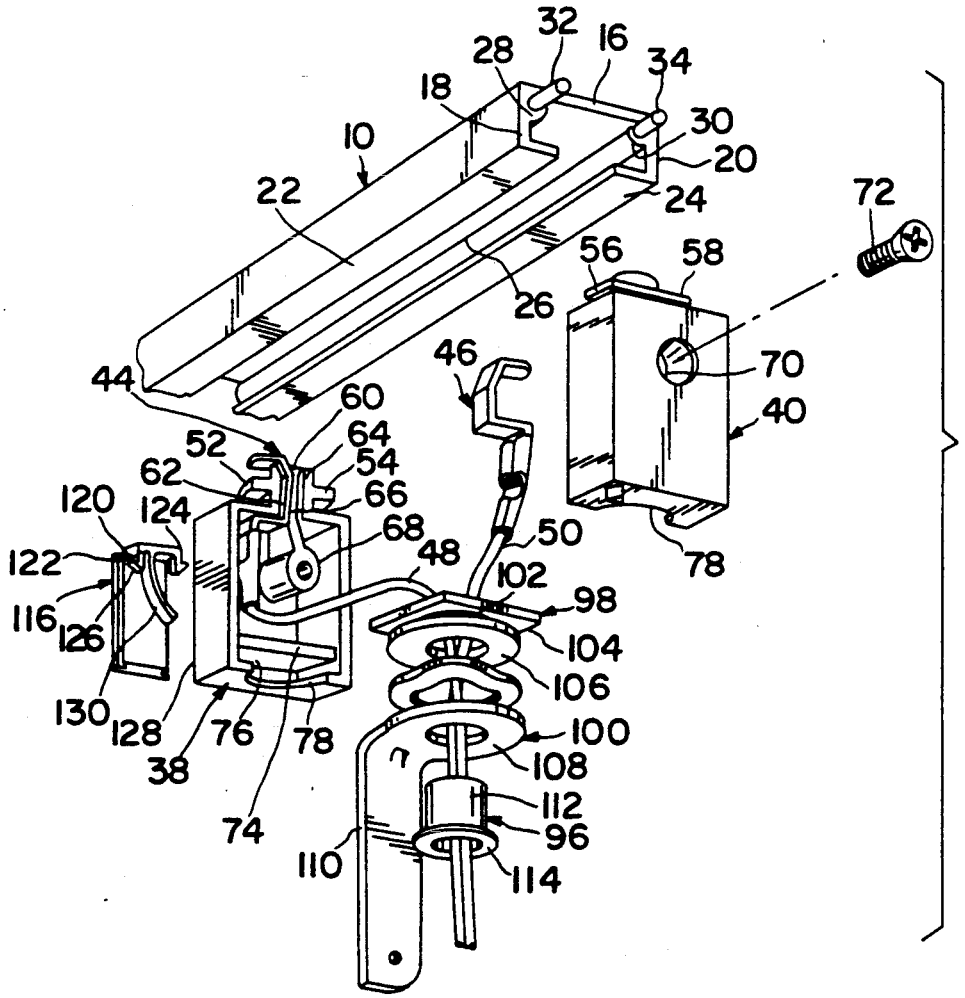
FIG. 2 is an exploded view of the adapter box of FIG. 1.
Figure 3:
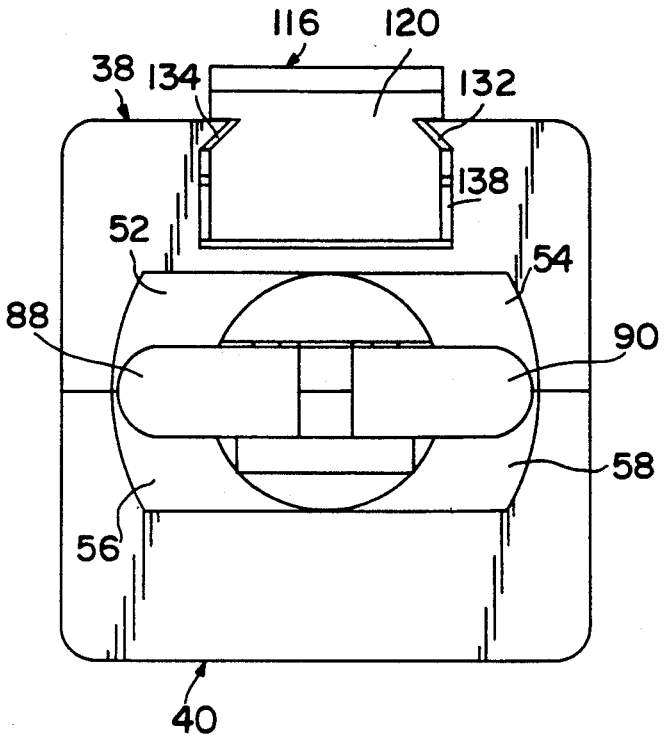
FIG. 3 is a top view of the adapter box of FIG. 1.
Figure 4:
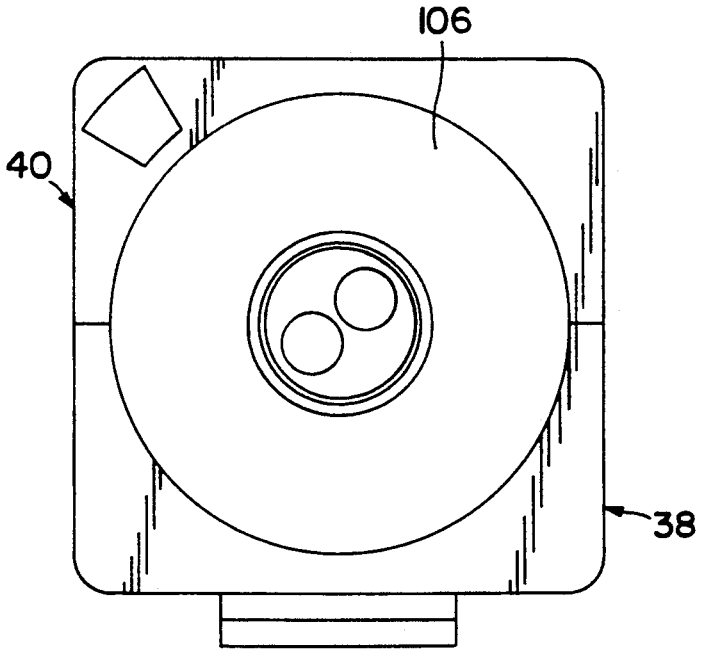
FIG. 4 is a bottom view of the adapter box of FIG. 1, but with a bracket removed to show better the construction of the box.
Figure 5:
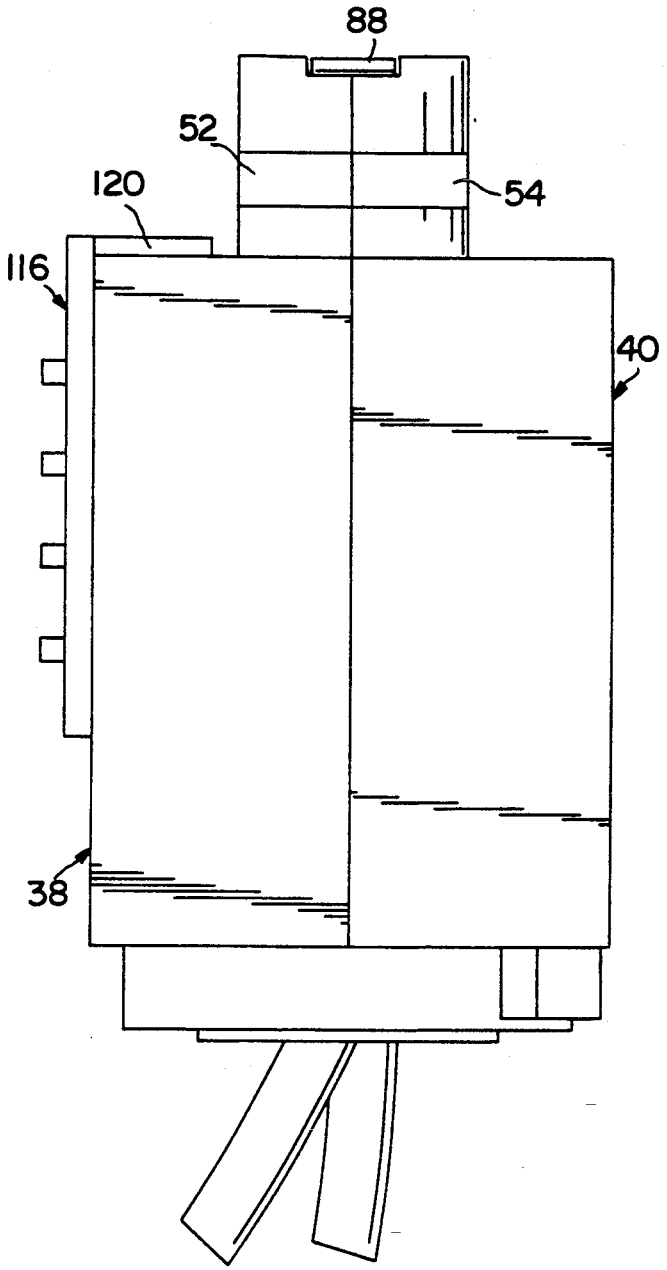
FIG. 5 is a side elevational view of the adapter box of FIG. 1, but with the bracket removed in order to show better the construction of the adapter box.
Figure 6:
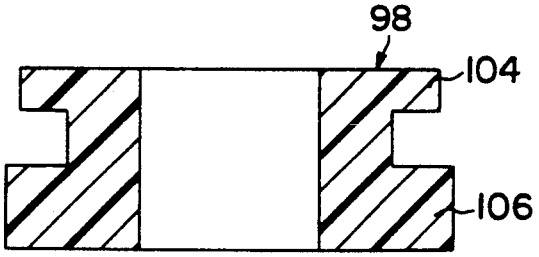
FIG. 6 is a cross sectional view through a rivet support which is a portion of a wire guide assembly.

Referring now to the drawings, and especially to FIG. 1, a conventional low voltage lighting fixture track 10 is shown with an adapter box 12 mounted thereon. The adapter box 12 is a specific embodiment of the herein disclosed invention.

Low voltage lighting fixture track 10 generally includes a track body 14, which body is an insulator extruded plastic body. The track body includes an elongated web 16 with conventional flanges 18 and 20 formed integral with the longitudinal edges of web 16. Opposed inwardly extending edges 22 and 24 are formed integral with flanges 18 and 20. Edges 22 and 24 extend along the length of web 16 and form a space 26 between the edges to receive a portion of adapter box 12. Ears 28 and 30 are formed integral with flanges 18 and 20, respectively. Conventional conductive wires or bus bars 32 and 34 are mounted on ears 28 and 30, respectively. The ears provide a conventional means for holding the conductive wires or track bus bars in position but allowing them to be available for contacting a part of the adapter box.

Adapter box 12 generally includes a housing 36 made up of a pair of housing halves 38 and 40. The housing halves 38 and 40 are injection molded insulator plastic parts which receive a wire guide assembly 42. A pair of contacts 44 and 46 is mounted in the housing. Contacts 44 and 46 are connected to conventional fixture wires 48 and 50, respectively. The fixture wires are inserted in the wire guide assembly and are connected to a selected low voltage lighting fixture which is not shown herein.

Housing half 38 includes a portion of mounting ears 52 and 54 formed integral therewith. Housing half 40 also includes a portion of mounting ears 56 and 58 which cooperate with portions 52 and 54 to form complete ears. The housing halves define a contact opening 60 which communicates with contact grooves 62 and 64 of housing half 38. Housing half 40 has like contact grooves for receipt of contacts. Housing half 38 includes a contact separator 66 which is an integral portion of housing 38. Housing half 38 includes an integral screw post 68. Housing half 40 includes a screw opening 70 which is alignable with the screw post 68. A conventional closure screw 72 extends through opening 70 and into post 68 to secure housing half 40 to housing half 38.

Housing half 38 includes an integral wire lock bar 74. A like wire lock bar is formed in housing half 40 which is not shown herein. A yoke lock opening 76 is formed in the housing half 38. A like opening is formed in housing half 40. Each of the housing halves includes a semicircular opening 78 for receipt of a portion of the wire guide assembly 42.

Contacts 44 and 46 are identical in construction. Contacts 44 and 46 include contact bodies 80 and 82, respectively. Respective contact bodies 80 and 82 are electrically connected to conventional quick connectors 84 and 86 mounted on wires 48 and 50, respectively. Connectors 46 and 48 each have a foot 88 and 90, respectively, which are engageable with and electrically conductive to conductive wires 32 and 34 of the track. Each foot 88 and 90 is formed integral with respective conductive tabs 92 and 94 which are connected to conventional quick connectors 84 and 86 to complete a conductive path from each foot 88 and 92 to the respective fixture wires 48 and 50. The contact bodies 80 and 82 are mounted in contact grooves 62 and 64, respectively.

Figure 7A:
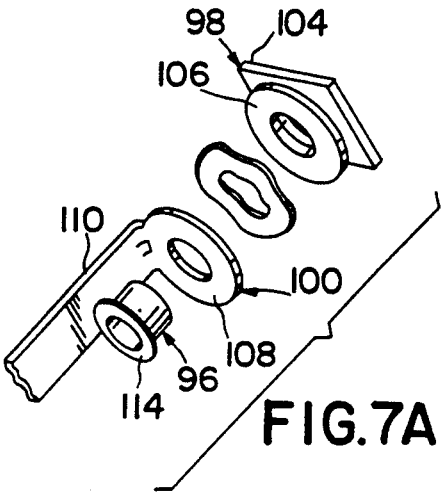
FIG. 7A is a perspective exploded view of a wire guide assembly which is a portion of the adapter box.
Figure 7B:
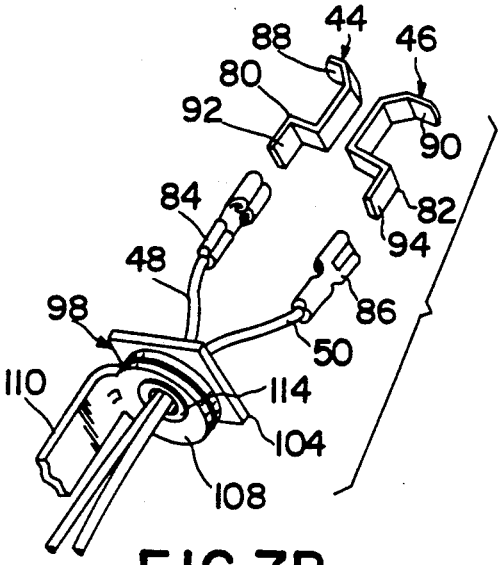
FIG. 7B is a perspective view of the wire guide assembly assembled with fixture wires extending through the wire guide and contacts exploded from a quick connect secured to each of a pair of fixture wires.

Wire guide assembly 42 generally includes a hollow rivet 96 which is mounted in a rivet support 98. A bracket 100 is connected to the rivet support by rivet 96. The rivet support includes a support body 102 with a square lock flange 104 formed integral with one end of the support body. An annular collar 106 is formed integral with the other end of the support body. The bracket is conventional in that it includes a lock ring 108 with a conventional arm 110 formed integral with the lock ring. The arm 110 is connected to a conventional low voltage lighting fixture (which is not shown). Rivet 96 includes a hollow rivet body 112 which is positioned in the lock ring 108 and the rivet support. The rivet has a head 114 on one end and the other end of the rivet is set once it is assembled to lock the bracket to the rivet support. As may be seen in FIG. 7A, the rivet is positioned through lock ring 108 and through rivet support 98. The rivet conventionally has its end set to lock the bracket to the rivet support.

Figure 8A:
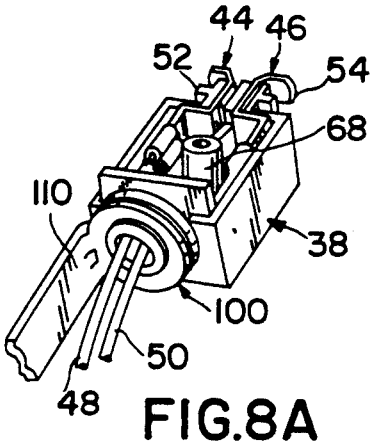
FIG. 8A is a perspective view of an adapter box, but with the cover removed in order to show better the position of the various parts when the adapter box is partially assembled.
Figure 8B:
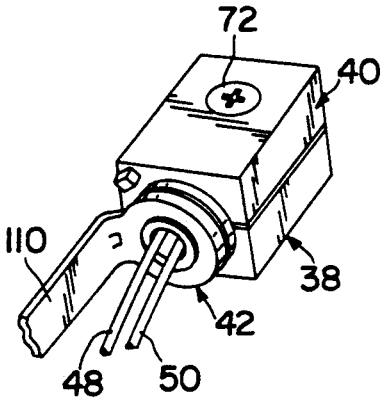
FIG. 8B is a perspective view of the adapter box of FIG. 8A, but with a cover in position.
Figure 8C:
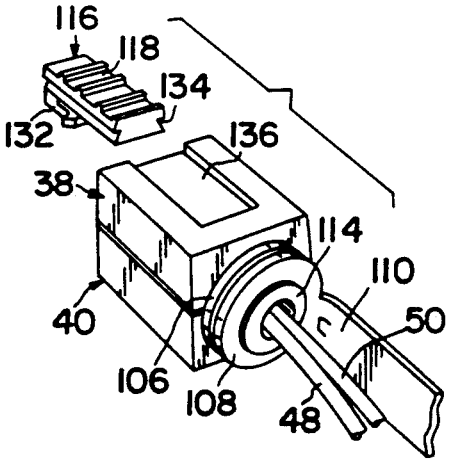
FIG. 8C is a perspective view of the adapter box of FIG. 8A, but with a latch in an exploded position.
Figure 10:
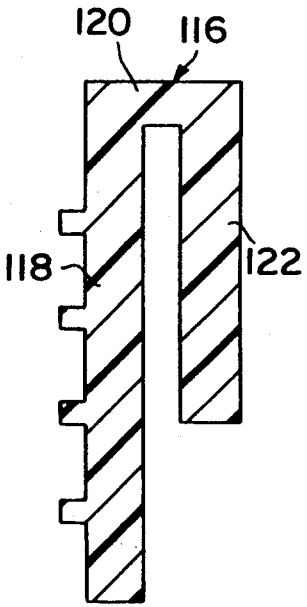
FIG. 10 is a cross sectional view through a latch which is shown in FIG. 9A.
Figure 9B:
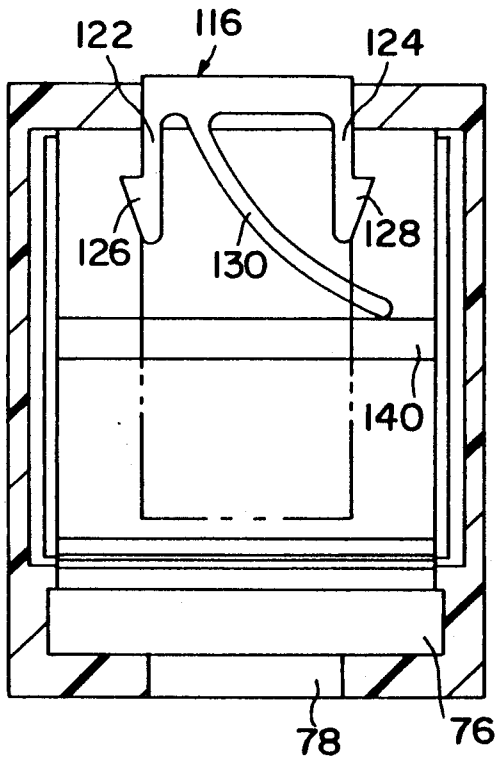
FIG. 9B is a cross sectional view similar to FIG. 9A, but showing the latch in a depressed position.
Figure 9A:
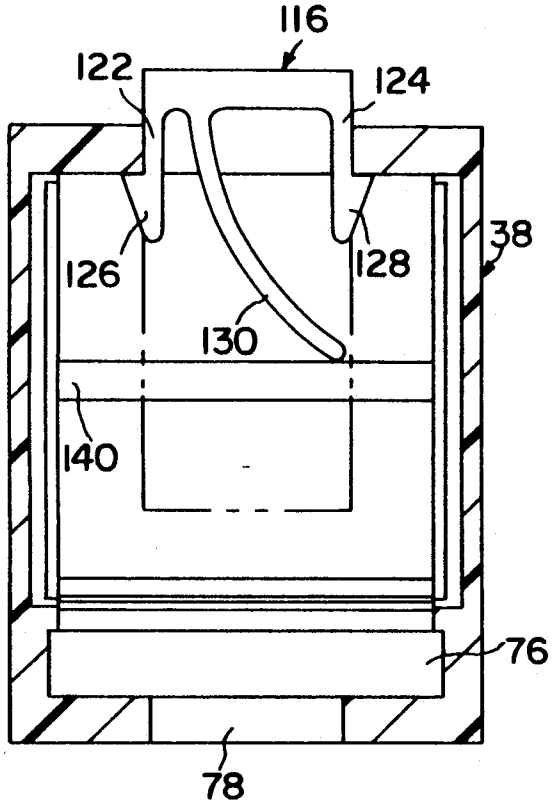
FIG. 9A is a cross sectional view through a portion of a housing showing the interior position of a latch and a spring arm of the latch.

Fixture wires 48 and 50 are passed through the rivet. The quick connects 84 and 86 are secured to the wires and contact bodies 80 and 82 are mounted on quick connects 84 and 86, respectively. The fixture wires with the contacts are then placed in housing half 38 as shown in FIG. 8A. The wire guide assembly is positioned in housing half 38 with the square lock flange mounted in opening 76. The housing half 40 is positioned in mating engagement with the lock flange and housing half 38. Screw 78 is inserted to lock the halves together and thereby lock the wire guide assembly and contacts into position.

The adapter box is completed with the addition of latch 116. Latch 116 includes a latch body 118 which has an off-set 120 formed integral therewith. The off-set has a pair of resilient arms 122 and 124 formed integral therewith. Dogs 126 and 128 are formed integral with the ends of arms 122 and 124, respectively. A resilient spring arm 130 is formed integral with off-set 120. Latch body 118 includes a pair of longitudinal grooves 132 and 134. Housing half 38 includes a latch recess 136 with slides for positioning in grooves 132 and 134. Housing half 38 includes a latch slot 138 which receives latch body 18. Housing half 38 includes an integral spring platform 140 engageable with spring arm 130.

The latch is inserted into slot 138. The resilience of arms 122 and 124 allows the dogs to enter the slot. However, the resilience of the dogs pushes the dogs outward to lock the latch in the slot. Spring arm 130 urges the latch upward.

In operation, the adapter box is positioned with mounting ears formed by portions 52 and 56 and 54 and 58 to be positioned in space 26 between opposed edges 22 and 24. Latch 116 is depressed against the force of the spring. The adapter box is rotated 90 degrees until contacts 44 and 46 contact wires 32 and 34 to make a secure electrical contact between the contacts and the wires. The mounting ears in contact with the opposed edges provides a secure mechanical support for the adapter box. The resilience of the spring arm 130 pushes the latch upward so that the latch is positioned in space 26 to lock the adapter box into position.

The adapter box may be removed from the track by pushing the latch down against the force of spring 130 and then rotating the housing to align the ears and the contacts with the space between the opposed edges. The adapter box may then be removed from the track.

Although a specific embodiment of the herein disclosed invention has been shown and described in detail above, it is readily appreciated that those skilled in the art may make various modifications and changes without departing from the spirit or the scope of the instant invention. It is to be expressly understood that the herein above invention is only limited by the appended claims.

We claim:

1. An adapter box for mounting on a low voltage lighting fixture track, said track having a track body and a pair of parallel conductive wires mounted in the body, said body having a web with a flange formed integral with each of opposed sides, a pair of opposed inwardly extending edges formed integral with the flanges, said adapter box including: a housing including a pair of housing halves secured to each other, said housing having a pair of mounting ears connectable to the track body, said housing having a contact opening adjacent to the mounting ears, a pair of contacts mounted in the housing for engaging in electrically conductive contact with respective conductive wires in said body, a fixture wire connected to each of the contacts, a contact separator molded as one-piece with one of said housing halves in the contact opening holding the contacts apart, a wire guide assembly mounted in the housing providing a conduit through the housing, and a latch mounted on one of the housing halves for selectively preventing the housing from rotating relative to the track body.

2. An adapter box for mounting on a low voltage lighting fixture track as defined in claim 1, wherein the wire guide assembly includes a rivet support, said rivet support having a support body, a lock flange formed integral with the support body and being positionable interiorly of the housing to be held therein, and an annular collar formed integral with the support body and positionable exteriorly of the housing, a bracket positioned adjacent to the annular collar, and a hollow rivet extending through a portion of the bracket and through the rivet support and being set for securing the bracket to the rivet support, said fixture wires positioned in the rivet.

3. An adapter box for mounting on a low voltage lighting fixture track as defined in claim 1, wherein each of the contacts includes a contact foot engageable with its respective conductive wire, each of the contacts having a conductor portion formed integral with the foot, and a quick connect connected to each conductor portion and connected to a respective fixture wire.

4. An adapter box for mounting on a low voltage lighting fixture track as defined in claim 1, including, a wire lock bar formed integral with one of said housing halves, and a second wire lock bar formed integral with the other of said housing halves and being positioned adjacent to the first mentioned wire lock bar for receiving the fixture wires between the wire lock bars for holding the fixture wires between the wire lock bars.

5. An adapter box for mounting on a low voltage lighting fixture track as defined in claim 1, wherein one of said housing halves includes a latch groove and a spring plate formed integral with the interior of the housing half, said housing half having a latch slot positioned adjacent to the latch groove and adjacent to the spring plate, and said latch having a latch body with a groove contained therein for mating with the latch groove, and a resilient arm formed integral with the latch body to contact the spring plate to urge the latch out of the housing half, said latch including a pair of resilient mounted dogs for entry into the housing half through the slot for preventing removal of the latch.

6. An adapter box for mounting on a low voltage lighting fixture track as defined in claim 1, wherein the wire guide assembly includes a rivet support, said rivet support having a support body, a lock flange formed integral with the support body and being positionable interiorly of the housing to be held therein, an annular collar formed integral with the support body and positionable exteriorly of the housing, a bracket positioned adjacent to the annular collar, a hollow rivet extending through a portion of the bracket and through the rivet support and being set for securing the bracket to the rivet support, said fixture wires positioned in the rivet, each of the contacts includes a contact foot engageable with its respective conductive wire, each of the contacts having a conductor portion formed integral with its respective foot, and a quick connect connected to each conductor and connected to a respective fixture wire.

7. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, each of the contacts includes a contact foot engageable with its respective conductive wire, each of the contacts having a conductor portion formed integral with the foot, and a quick connect connected to each conductor and connected to a respective fixture wire.

8. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, one of said housing halves including a latch groove and a spring plate formed integral with the interior of the housing half, said one of said housing halves having a latch slot positioned adjacent to the latch groove and adjacent to the spring plate, said latch having a latch body with a groove contained therein mateable with the latch groove, a resilient arm formed integral with the latch body to contact the spring plate to urge the latch out of the housing half, and said latch including a pair of resiliently mounted dogs for entry into the housing half through the slot for preventing removal of the dogs.

9. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, the wire guide assembly includes a rivet support, said rivet support having a support body, a lock flange formed integral with the support body and being positionable interiorly of the housing to be held therein, an annular collar formed integral with the support body and positionable exteriorly of the housing, a bracket positioned adjacent to the annular collar, a hollow rivet extending through a portion of the bracket and through the rivet support and being set for securing the bracket to the rivet support, said fixture wires positioned in the rivet.

10. An adapter box for mounting on a low voltage lighting fixture track as defined in claim 1, wherein the wire guide assembly includes a rivet support, said rivet support having a support body, a lock flange formed integral with the support body and being positionable interiorly of the housing halves to be held therein, and annular collar formed integral with the support body and positionable exteriorly of the housing halves, a bracket positioned adjacent to the annular collar, and a hollow rivet extending through a portion of the bracket and through the rivet support and being set for securing the bracket to the rivet support, said fixture wires positioned in the rivet, one of said housing halves includes a latch groove and a spring plate formed integral with the interior of the housing half, said one of said housing halves having a latch slot positioned adjacent to the latch groove and adjacent to the spring plate, said latch having a latch body with a groove contained therein for mating with the latch groove, and a resilient arm formed integral with the latch body to contact the spring plate to urge the latch out of the housing half, said latch including a pair of resiliently mounted dogs for entry into the housing half through said slot for preventing removal of the latch.

11. An adapter box for mounting on a low voltage lighting fixture track as defined in claim 1, wherein each of the contacts includes a contact foot engageable with its respective conductive wire, each of the contacts having a conductor portion formed integral with the foot, and a quick connect connected to the conductor and connected to a respective fixture wire, one of said housing halves includes a latch groove and a spring plate formed integral with the interior of the housing half, said one of said housing halves having a latch slot positioned adjacent to the latch groove and adjacent to the spring plate, said latch having a latch body with a groove contained therein for mating with the latch groove, a resilient arm formed integral with the latch body to contact the spring plate to urge the latch out of the housing half, and said latch including a pair of resiliently mounted dogs for entry into the housing half through the slot for preventing removal of the latch.

12. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, said wire guide assembly includes a rivet support, said rivet support having a support body, a lock flange formed integral with the support body and being positionable interiorly of the housing to be held therein, and annular collar formed integral with the support body and positionable exteriorly of the housing, a bracket positioned adjacent to the annular collar, and a hollow rivet extending through a portion of the bracket and through the rivet support and being set for securing the bracket to the rivet support, said fixture wires positioned in the rivet, each of the contacts includes a contact foot engageable with its respective conductive wire, each of the contacts having a conductor portion formed integral with its respective foot, and a quick connect connected to each conductor and connected to its respective fixture wire.

13. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, the wire guide assembly includes, a rivet support, said rivet support having a support body, a lock flange formed integral with the support body and being positionable interiorly of the housing to be held therein, annular collar formed integral with the support body and positionable exteriorly of the housing, a bracket positioned adjacent to the annular collar, a hollow rivet extending through a portion of the bracket and through the rivet support and being set for securing the bracket to the rivet support, said fixture wires positioned in the rivet, one of said housing halves includes a latch groove and a spring plate formed integral with the interior of the housing half, said one of said housing halves having a latch slot positioned adjacent to the latch groove and adjacent to the spring plate, said latch having a latch body with a groove contained therein for mating with the latch groove, a resilient arm formed integral with the latch body to contact the spring plate to urge the latch out of the housing half, said latch including a pair of resiliently mounted dogs for entry into the housing half through the slot for preventing removal of the latch.

14. An adapter box for mounting on a low voltage lighting fixture track as defined in claim 1, wherein the wire guide assembly includes a rivet support, said rivet support having a support body, a lock flange formed integral with the support body and being positionable interiorly of the housing to be held therein, and annular collar formed integral with the support body and positionable exteriorly of the housing, a bracket positioned adjacent to the annular collar, and a hollow rivet extending through a portion of the bracket and through the rivet support and being set for securing the bracket to the rivet support, said fixture wires positioned in the rivet, each of the contacts includes a contact foot engageable with its respective conductive wire, each of the contacts having a conductor portion formed integral with the foot, a quick connect connected to each conductor and connected to a respective fixture wire, one of said housing halves includes a latch groove and a spring plate formed integral with the interior of the housing half, said one of said housing halves having a latch slot positioned adjacent to the latch groove and adjacent to the spring plate, said latch having a latch body with a body groove contained therein for mating with the latch groove, a resilient arm formed integral with the latch body to contact the spring plate to urge the latch out of the housing half, and said latch including a pair of resiliently mounted dogs for entry into the housing half through the slot for preventing removal of the latch.

15. An adapter box for mounting on a low voltage lighting fixture track as defined in claim 1, including, a wire lock bar formed integral with one of said housing halves, a second wire lock bar formed integral with the other of said housing halves and being positioned adjacent to the first mentioned wire lock bar for receiving the fixture wires between the wire lock bars for holding the fixture wires between the wire lock bars, the wire guide assembly includes, a rivet support, said rivet support having a support body, a lock flange formed integral with the support body and being positionable interiorly of the housing halves to be held therein, an annular collar formed integral with the body and positionable exteriorly of the housing halves, a bracket positioned adjacent to the annular collar, and a hollow rivet extending through a portion of the bracket and through the rivet support and being set adjacent to the rivet support and to the bracket for securing the bracket to the rivet support, said fixture wires positioned in the rivet, each of the contacts includes a contact foot engageable with its respective conductive wire, each of the contacts having a conductor portion formed integral with its respective foot, and a quick connect connected to one of the conductors and to a respective fixture wire, one of said housing halves includes a latch groove and a spring plate formed integral with the interior of the housing half, said housing half having a latch slot positioned adjacent to the latch groove and adjacent to the spring plate, said latch having a latch body with a body groove contained therein for mating with the latch groove, a resilient arm formed integral with the latch body to contact the spring plate to urge the latch out of the housing half, and said latch including a pair of resiliently mounted dogs for entry into the housing half through the slot for preventing removal of the latch from the slot.

* * * * *